US007477203B2

(12) United States Patent
Park

(10) Patent No.: US 7,477,203 B2
(45) Date of Patent: Jan. 13, 2009

(54) ELEVATION ANGLE CONTROL APPARATUS FOR SATELLITE-TRACKING ANTENNA

(75) Inventor: Chan goo Park, Daejeon (KR)

(73) Assignee: Wiworld Co., Ltd., Daejeon (KR)

( * ) Notice: Subject to any disclaimer, the term of this patent is extended or adjusted under 35 U.S.C. 154(b) by 229 days.

(21) Appl. No.: 11/628,370

(22) PCT Filed: Jun. 18, 2004

(86) PCT No.: PCT/KR2004/001463

§ 371 (c)(1),
(2), (4) Date: Dec. 1, 2006

(87) PCT Pub. No.: WO2005/122329

PCT Pub. Date: Dec. 22, 2005

(65) Prior Publication Data

US 2007/0216592 A1 Sep. 20, 2007

(30) Foreign Application Priority Data

Jun. 9, 2004 (KR) ..... 10-2004-0042039

(51) Int. Cl.
*H01Q 3/00* (2006.01)

(52) U.S. Cl. ..... 343/765; 343/766

(58) Field of Classification Search ..... 343/765, 343/766, 757, 763, 761, 878, 880, 882, 713; 342/75, 76, 352, 359, 426
See application file for complete search history.

(56) References Cited

U.S. PATENT DOCUMENTS 4,887,091 A 12/1989 Yamada
5,528,250 A 6/1996 Sherwood et al.
6,023,247 A 2/2000 Rodeffer
6,188,367 B1 2/2001 Morrison et al.
6,538,612 B1 3/2003 King
6,937,199 B2 * 8/2005 King ..... 343/757

FOREIGN PATENT DOCUMENTS

JP 09148817 6/1997
KR 10-2003-0030391 4/2003

OTHER PUBLICATIONS

International Search Report.

* cited by examiner

*Primary Examiner*—Hoang V Nguyen
*Assistant Examiner*—Robert Karacsony
(74) *Attorney, Agent, or Firm*—Collard & Roe, P.C.

(57) ABSTRACT

The present invention relates to an artificial satellite tracking antenna installed in moving objects, such as vehicles, ships, trains, or the like, and automatically tracking position of the satellite such that viewers may conveniently watch satellite broadcasting when in motion without adjusting the antenna. In order to adjust elevation angle of the antenna 10, an elevation angle control apparatus includes a belt 50 in which one end 52 is fixed to the supporting bracket 30 and the other end 54 is fixed to an upper end 22 of the frame 20, a driving motor 60 for driving the belt 50, a fixed pulley 70 disposed between the driving motor 60 and the belt 50 fixed to the supporting bracket 30, a movable pulley 80 disposed between the fixed pulley 70 and the one end 52 of the belt 50 fixed to the supporting bracket 30, and a rod 90, in which the movable pulley 80 is rotatably fixed to one end 92 thereof and the other end 94 thereof is pivotally fixed to the frame 20, wherein the belt 50 is connected from the upper end 22 of the frame 20 to the supporting bracket 30 via the driving motor 60, the fixed pulley 70 and the movable pulley 80, and the elevation angle is adjusted such that the frame 20 is rotated about the elevation angle shaft 40 by the pulling of the belt 50 and the pushing of the rod 90 due the forward and backward rotation of the driving motor 60.

7 Claims, 7 Drawing Sheets

ELEVATION ANGLE CONTROL APPARATUS FOR SATELLITE-TRACKING ANTENNA

CROSS REFERENCE TO RELATED APPLICATIONS

Applicant claims priority under 35 U.S.C. §119 of Korean Application No. 10 2004 0042039 filed on Jun. 9, 2004. Applicant also claims priority under 35 U.S.C. §365 of PCT/KR2004/001463 filed on Jun. 18, 2004. The international application under PCT article 21(2) was published in English.

TECHNICAL FIELD

The present invention relates to an elevation angle control apparatus for satellite-tracking antenna, and more particularly, to an elevation angle control apparatus for satellite-tracking antenna requiring a small installation space by solving shortcomings of conventional linear motor type and belt type elevation angle control apparatus and by simplifying a structure mechanism so as to minimize the size of a parabola satellite antenna and a flat satellite antenna, and capable of accurately and stably adjusting elevation angle by removing backlash, vibration generated when adjusting elevation angle of the satellite-tracking antenna.

BACKGROUND ART

Satellite receivers are installed in moving objects, such as vehicles, ships, trains, or the like, to automatically track the position of an artificial satellite such that viewers can watch satellite broadcasting without adjusting a satellite antenna. The satellite receiver includes a satellite antenna, an exclusive tuner, and a monitor. An antenna body is installed with a device for adjusting azimuth angle and elevation angle of the satellite antenna such that the position of the satellite is automatically tracked without adjustment of the wave-receiving angle of the satellite antenna.

As for an elevation angle control apparatus of a satellite-tracking antenna related to the present invention, a gear type elevation angle control apparatus, a linear motor type elevation angle control apparatus, and a belt type elevation angle control apparatus are generally used.

The three elevation angle control apparatuses will be described in brief. First, the gear type elevation angle control apparatus, as disclosed in U.S. Pat. No. 4,887,091 granted to Takahiro Yamada and U.S. Pat. No. 6,023,247 granted to Charles Eugene Rodeffer, has a simple structure such that a geared motor coupled with an elevation angle shaft adjusts elevation angle of a frame for supporting an antenna but also has drawbacks such that adjustment of the elevation angle of the antenna is not stable because of backlash the antenna is vibrated by moment of inertia when adjusting elevation angle of the antenna. Moreover, since driving power is transmitted when gears of the geared motor are engaged with gears of the elevation angle shaft, minute and accurate adjustment of elevation angle of the antenna is restricted.

The linear motor type elevation angle control apparatus, as disclosed in U.S. Pat. No. 5,528,250 granted to William J. Sherwood, has a structure wherein a shaft of a linear motor is directly and pivotally coupled to a location spaced apart from an elevation angle shaft of a frame for supporting an antenna, or a separate link mechanism is disposed between a supporting bracket and a frame and the shaft of the linear motor is coupled with a side of the link mechanism to expand and contract the shaft of the linear motor. The linear motor type elevation angle control apparatus adjusts elevation angle of the satellite antenna by pushing and pulling the link mechanism. Although, since a point to which force for adjusting elevation angles of the elevation angle shaft and the antenna is applied, is separated, the backlash is reduced in comparison to the gear type elevation angle control apparatus, the backlash is still generated in the linear motor type elevation angle control apparatus. In the linear motor type elevation angle control apparatus employing the separated link mechanism, its structure becomes complex, and additionally, control for the adjustment of minute elevation angle is difficult because of the shaft of the linear motor directly coupled with the frame or the link mechanism.

A typical belt type elevation angle control apparatus is disclosed in U.S. Pat. No. 6,188,367 granted to Stephan A. Morrison. According to Morrison's patent, belts are connected to both ends of a frame for supporting an antenna and are pulled to one side or the other by rotating a driving device forward and backward such that the frame is rotated on an elevation angle shaft. The belt type elevation angle control apparatus is advantageous to remove the backlash, shortcoming of the gear type elevation angle control apparatus and the linear motor type elevation angle control apparatus, by driving the belts to adjust angle of the frame. However, the belt type elevation angle control apparatus also has shortcomings that a large space on the lower part of both sides of the frame is required to install the belts. Since the belts are long, the slack of the belts brought by long term use causes inaccurate driving and devices for guiding the belts must be installed in front of and at the rear side of the supporting bracket. Since both ends of the frame are connected to the belts, the frame must be longer than unnecessarily and its volume is increased. Moreover, since the structure of the frame of a flat type satellite antenna where the antenna is installed is different from that of a parabolic satellite antenna, the belt type elevation angle control apparatus cannot be applied to the flat type satellite antenna.

DISCLOSURE OF THE INVENTION

[Technical Problem]

Therefore, the present invention has been made in view of the above problems, and it is an object of the present invention to provide an elevation angle control apparatus having a simplified elevation angle adjusting mechanism and a small installation space enabling a satellite antenna to be reduced in size.

It is another object of the present invention to provide an elevation angle control apparatus without backlash generated when adjusting elevation angle in a conventional linear motor type elevation angle control apparatus and a conventional gear type elevation angle control apparatus and capable of minutely and stably adjusting elevation angle.

It is still another object of the present invention to provide an elevation angle control apparatus applied to both of a parabolic satellite antenna and a flat type satellite antenna regardless of their frame structures.

[Technical Solution]

In accordance with an aspect of the present invention, the above and other objects can be accomplished by an elevation angle control apparatus for adjusting elevation angle of a satellite antenna by adjusting angle of a frame, pivotally fixed to a supporting bracket by an elevation angle shaft, to which the satellite antenna is fixed, the elevation angle control apparatus including: a belt in which one end is fixed to the supporting bracket and the other end thereof is fixed to an upper end of the frame; a driving motor mounted on the supporting bracket and driving the belt; a fixed pulley rotatably fixed to the supporting bracket between the driving motor and the one end of the belt fixed to the supporting bracket; a movable pulley disposed between the fixed pulley and the one end of the belt fixed to the supporting bracket; and a rod in which the movable pulley is rotatably fixed to one end thereof and the other end thereof is pivotally fixed to the frame; wherein the belt is connected from the upper end of the frame to the supporting bracket via the driving motor, the fixed pulley and the movable pulley, and the elevation angle of the frame is adjusted such that the frame is rotated about the elevation angle shaft by the pulling of the belt caused by the forward and backward rotation of the driving motor and the movement of the rod caused by the pulling of the belt.

[Advantageous Effects]

As described above, since the elevation angle control apparatus uses the belt, in which both ends thereof are fixed to the supporting bracket and the frame, a pair of fixed pulleys, a pair of movable pulleys, and the rod having the one end, to which the one end of the movable pulley is connected and the other end pivotally connected to the frame, which are disposed at the rear side of the frame, interference generated when receiving satellite signals is minimized and volume of the satellite antenna employing the elevation angle control apparatus is reduced. The backlash generated when adjusting the elevation angle is effectively reduced by the pulling actions of belt and the supporting action of the rod contrary to the pulling action of the belt, and minute adjustments to the elevation angle are stably performed. Moreover, regardless of the frame's shape or form, the elevation angle control apparatus according to the present invention can be applied to parabolic satellite antennas and flat type satellite antennas.

DESCRIPTION OF DRAWINGS

The above and other objects, features and other advantages of the present invention will be more clearly understood from the following detailed description taken in conjunction with the accompanying drawings, in which.

DESCRIPTION OF REFERENCE NUMERALS FOR MAIN COMPONENTS OF THE DRAWINGS

Figure 1:
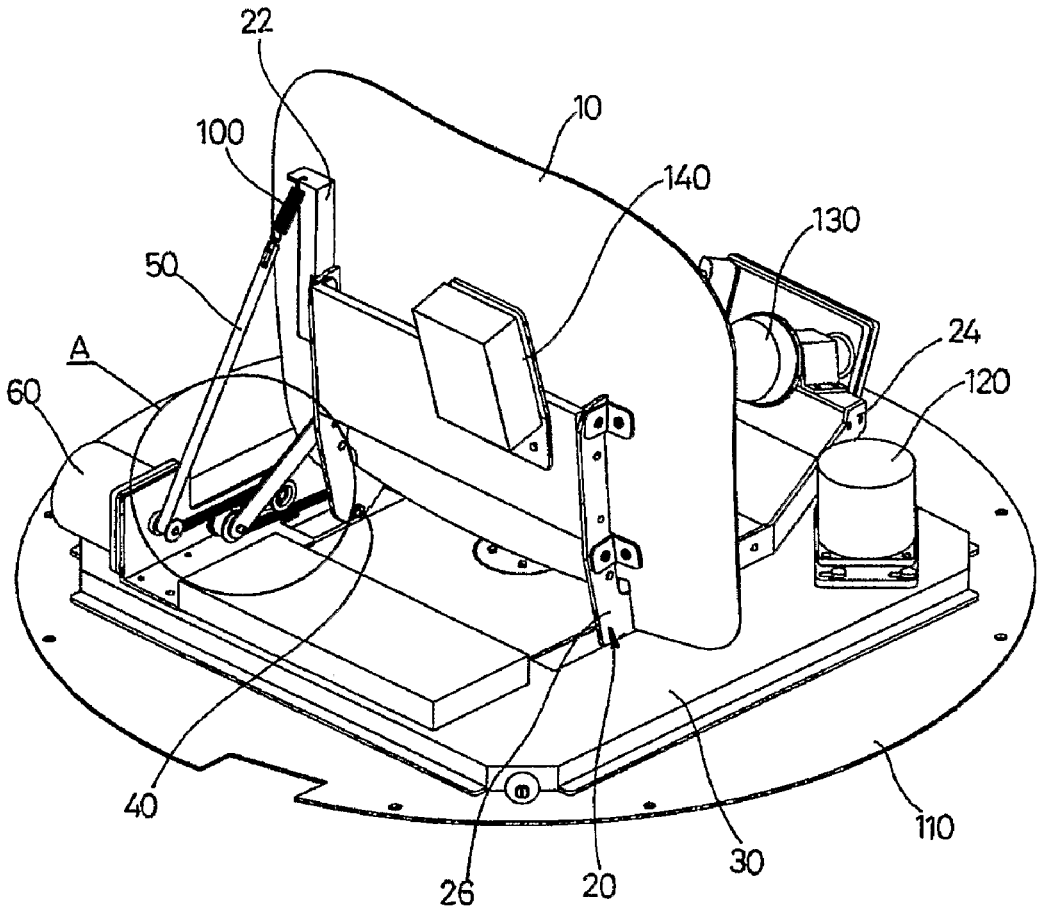
FIG. 1 is a perspective view illustrating a satellite antenna to which an elevation angle control apparatus according to a preferred embodiment of the present invention is installed.
Figure 2:
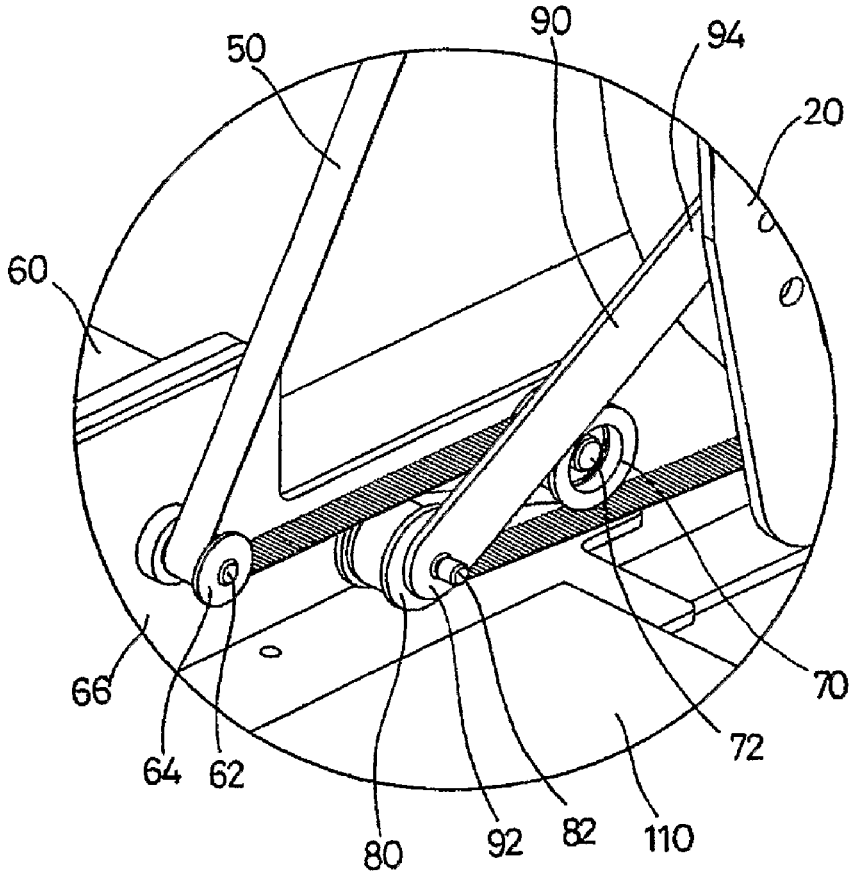
FIG. 2 is an enlarged perspective view of a portion "A" in FIG. 1.
Figure 3:
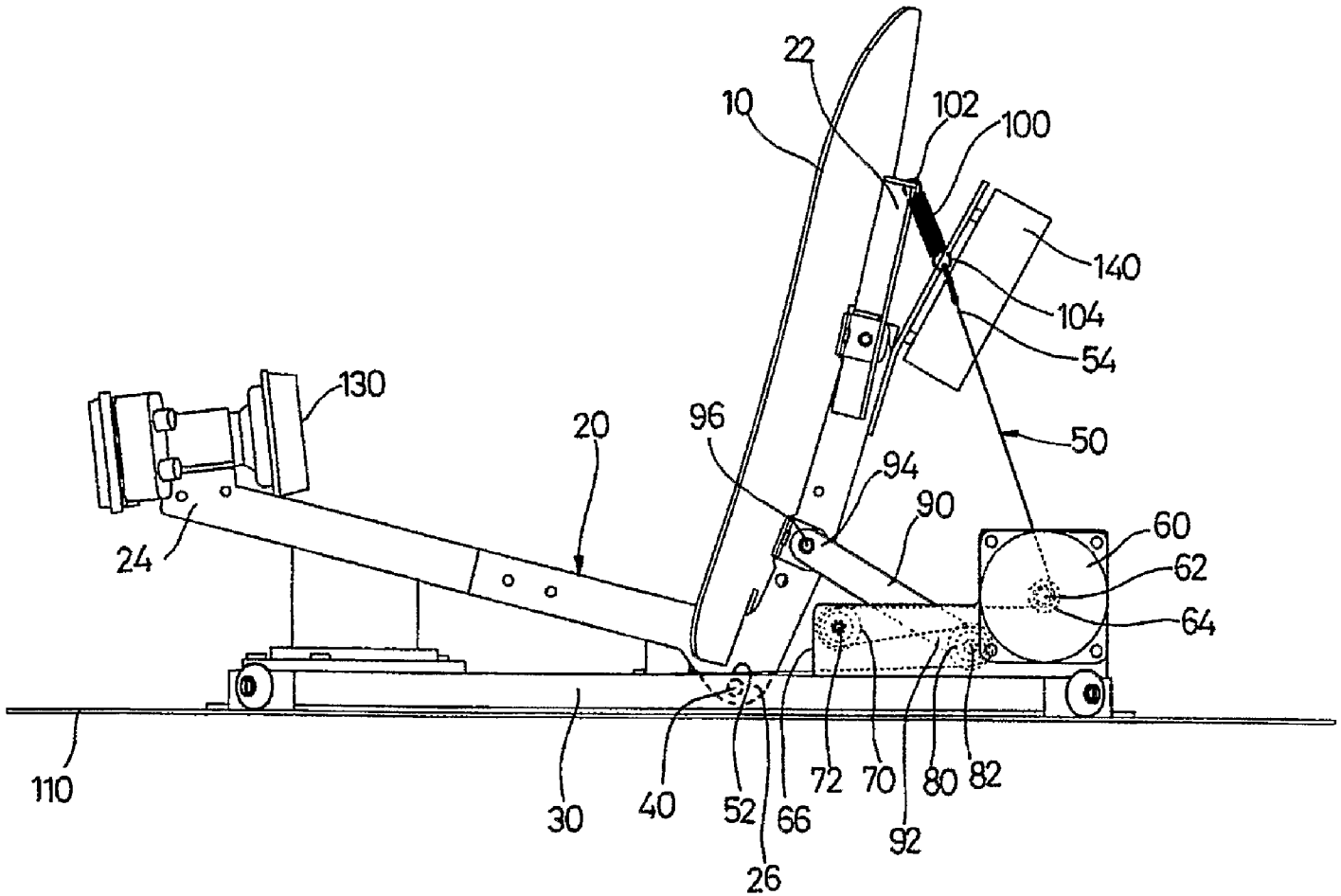
FIG. 3 is a side view of the satellite antenna to which the elevation angle control apparatus according to a preferred embodiment of the present invention is installed.
Figure 4:
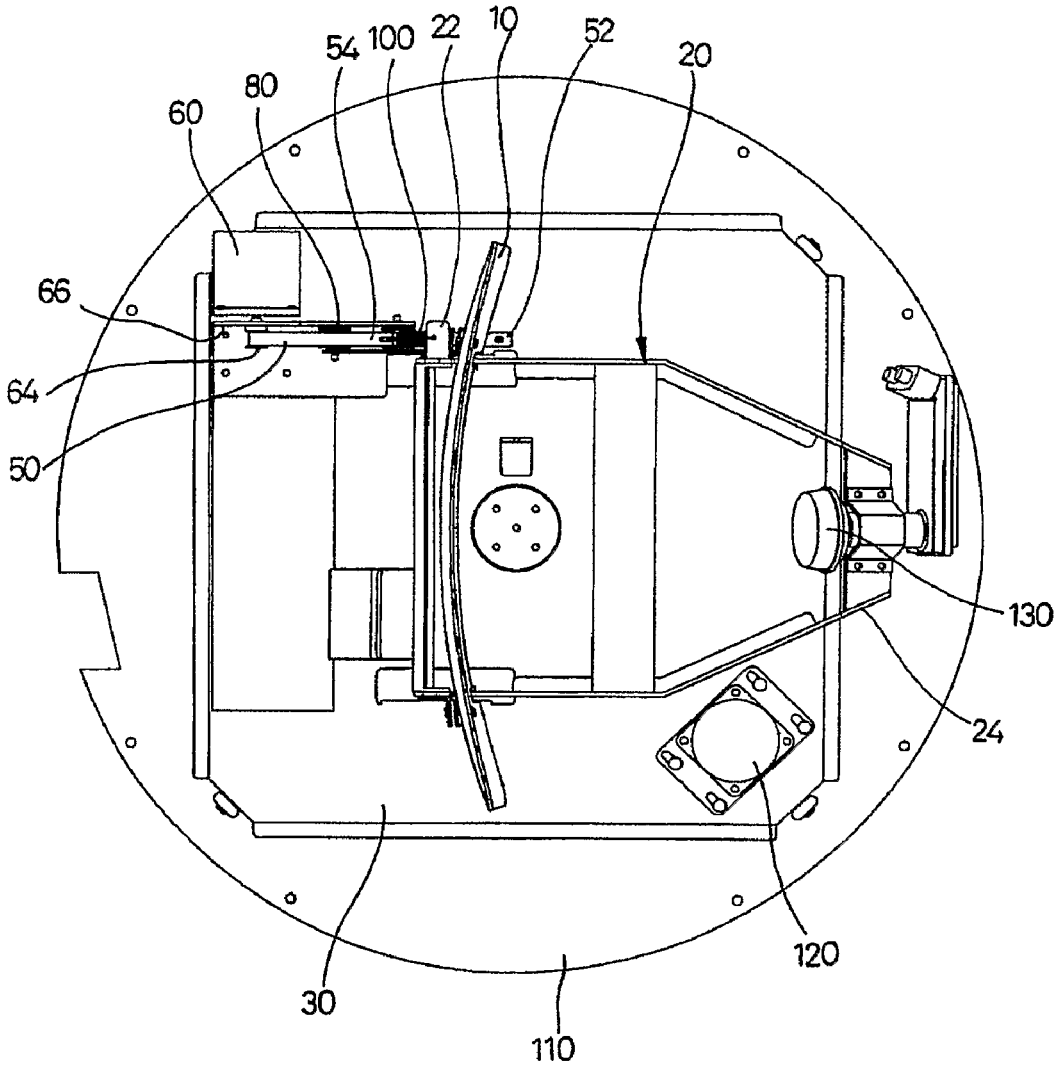
FIG. 4 is a plan view of the satellite antenna to which the elevation angle control apparatus according to a preferred embodiment of the present invention is installed.

| | |
|---|---|
| 10: antenna | 20: frame |
| 22: upper end of frame | 24: lower end of frame |
| 26: intermediate portion | 30: supporting bracket |
| 40: elevation angle shaft | 50: belt |
| 52: one end of belt 50 | 54: the other end of belt 50 |
| 60: driving motor | 62: shaft |
| 64: driving pulley | 66: fixed bracket |
| 70: fixed pulley | 72: fixed shaft |
| 80: movable pulley | 82: fixed shaft |
| 90: rod | 92: one end of rod 90 |
| 94: the other end of rod 90 | 96: pin |
| 100: elastic member | 110: base plate |
| 120: elevation angle adjusting driving motor | 140: gyroscopic sensor |
| 130: LNB | |

[BEST MODE]

Hereinafter, embodiments of the present invention will be described in detail with reference to the attached drawings. The present invention is not restricted to the following embodiments, and many variations are possible within the spirit and scope of the present invention. The embodiments of the present invention are provided in order to more completely explain the present invention to anyone skilled in the art.

FIGS. 1 to 4 show a satellite antenna to which an elevation angle control apparatus according to a preferred embodiment of the present invention is installed. The elevation angle control apparatus is structured such that a frame 20, to which an antenna 10 is fixed, is pivotally fixed to a supporting bracket 30 by an elevation angle shaft 40 and adjusts elevation angle of the antenna 10 by adjusting the angle of the frame 20. The elevation angle control apparatus includes a belt 50 in which one end 52 is fixed to the supporting bracket 30 and the other end thereof 54 is fixed to an upper end 22 of the frame 20; a driving motor 60 mounted on the supporting bracket 30 and driving the belt 50; a fixed pulley 70 rotatably fixed to the supporting bracket 30 between the driving motor 60 and one end 52 of the belt 50 fixed to the supporting bracket 30; a movable pulley 80 disposed between the fixed pulley 70 and one end 52 of the belt 50 fixed to the supporting bracket 30; and a rod 90 in which the movable pulley 80 is rotatably fixed to one end 92 thereof and the other end 94 thereof is pivotally fixed to the frame 20 by a pin 96; wherein the belt 50 is connected from the upper end 22 of the frame 20 to the supporting bracket 30 via the driving motor 60, the fixed pulley 70 and the movable pulley 80, and the elevation angle of the frame 20 is adjusted such that the frame 20 is rotated about the elevation angle shaft 40 by the pulling of the belt 50 caused by the forward and backward operation of the driving motor 60 and the movement of the rod 90 caused by the pulling of the belt 50.

In this preferred embodiment of the present invention, an elastic member 100 is disposed between the other end 54 of the belt 50 and the upper end 22 of the frame 20. The elastic member 100 provides a constant tensile force to the belt 50 when adjusting the elevation angle of the frame 20 and may be a tensile coil spring in which connectors 102 and 104 for connecting the elastic member 100 to the upper end 22 of the frame 20 and the other end 54 of the belt 50 are integrally formed at its ends. The elastic member 100 may also be elastic strings or band type rubber strings in addition to the coil spring, if they can guarantee excellent durability.

Reference numeral 110 is assigned to a base plate, reference numeral 120 is assigned to an azimuth angle adjusting driving motor for adjusting azimuth angle of the supporting bracket 30, to which the antenna 10 is installed, with respect to the base plate 30, reference numeral 130 is assigned to a low noise block down converter (LNB) installed to the other lower side of the frame 20, and reference numeral 140 is assigned to a gyroscopic sensor attached to the upper back surface of the frame 20.

Although the antenna 10 is depicted in the form of a parabolic satellite antenna in FIGS. 1 to 4, the elevation angle control apparatus according to a preferred embodiment of the present invention is not limited to this, but can be applied to a flat type satellite antenna. When the elevation angle control apparatus according to a preferred embodiment of the present invention is applied to the flat type satellite antenna, the structure of the frame 20 can be simplified and a front space of the satellite antenna can be reduced so that volume of the satellite-tracking antenna can be minimized.

In a preferred embodiment shown in FIGS. 1 to 4, in the frame 20, the upper end 22, to which the parabolic satellite antenna 10 is mounted, and the other lower end 24, to which the LNB 130 is installed, form an approximate right angle, and an intermediate part 26 of the frame 20 is rotatably fixed to the supporting bracket 30 by the elevation angle shaft 40. The gyroscopic sensor 140 is attached to the rear side of the upper end 22 of the frame 20 where the satellite antenna 10 is mounted, and detects movement of a moving object where the satellite antenna 10 is mounted, such as vehicles, ships, trains, or the like.

The supporting bracket 30 is mounted to the base plate 110 to rotate 360 degrees such that the supporting bracket 30 is rotated by the azimuth angle adjusting driving motor 120 to adjust the azimuth angle of the satellite antenna 10. A mechanism for adjusting the azimuth angle may use timing belts, or other proper devices, and the description of the mechanism depicted in the drawings will be omitted for the clear illustrative purpose because the description may confuse the subject matter of the present invention.

General belts may serve as the belt 50, however, preferably, a conventional timing belt, in which saw tooth-shaped grooves are continuously formed in one side thereof, is used, and a pulley, in which grooves are formed in one side thereof, is used as the driving pulley 64 coupled with a shaft 62 of the driving motor 60, so that the belt 50 is prevented from slipping when transmitting driving force.

The fixed pulley 70 is rotatably fixed to a fixed shaft 72 installed to the front side of a fixing bracket 66 for fixing the driving motor 60 to the supporting bracket 30, and the fixed pulley 70 changes the traveling direction of the belt 50 to connect the belt 50 to the movable pulley 80 described later.

The movable pulley 80 is disposed between the fixed pulley 70 and the driving pulley 64 of the driving motor 60 and closely contacts the upper surface of the supporting bracket 30 and reciprocally slides the upper surface of the supporting bracket 30 between the fixed pulley 70 and the driving pulley 64 by the forward and rearward traveling of the belt 50 wound around the movable pulley 80.

The rod 90 has one end 92 (depicted as the lower end in the drawings) where the movable pulley 80 is installed and the other end 94 (depicted as the upper end in the drawings) pivotally connected to the frame 20 between the intermediate part 26 and the upper end 22 by the pin 96, pushes to erect the frame 20 due to the reciprocal movement of the movable pulley 80 between the fixed pulley 70 and the driving pulley 64, and supports the frame 20 when the frame 20 is laid down by pulling the belt 50.

The operation of the elevation angle control apparatus according to a preferred embodiment of the present invention will be described.

Figure 5:
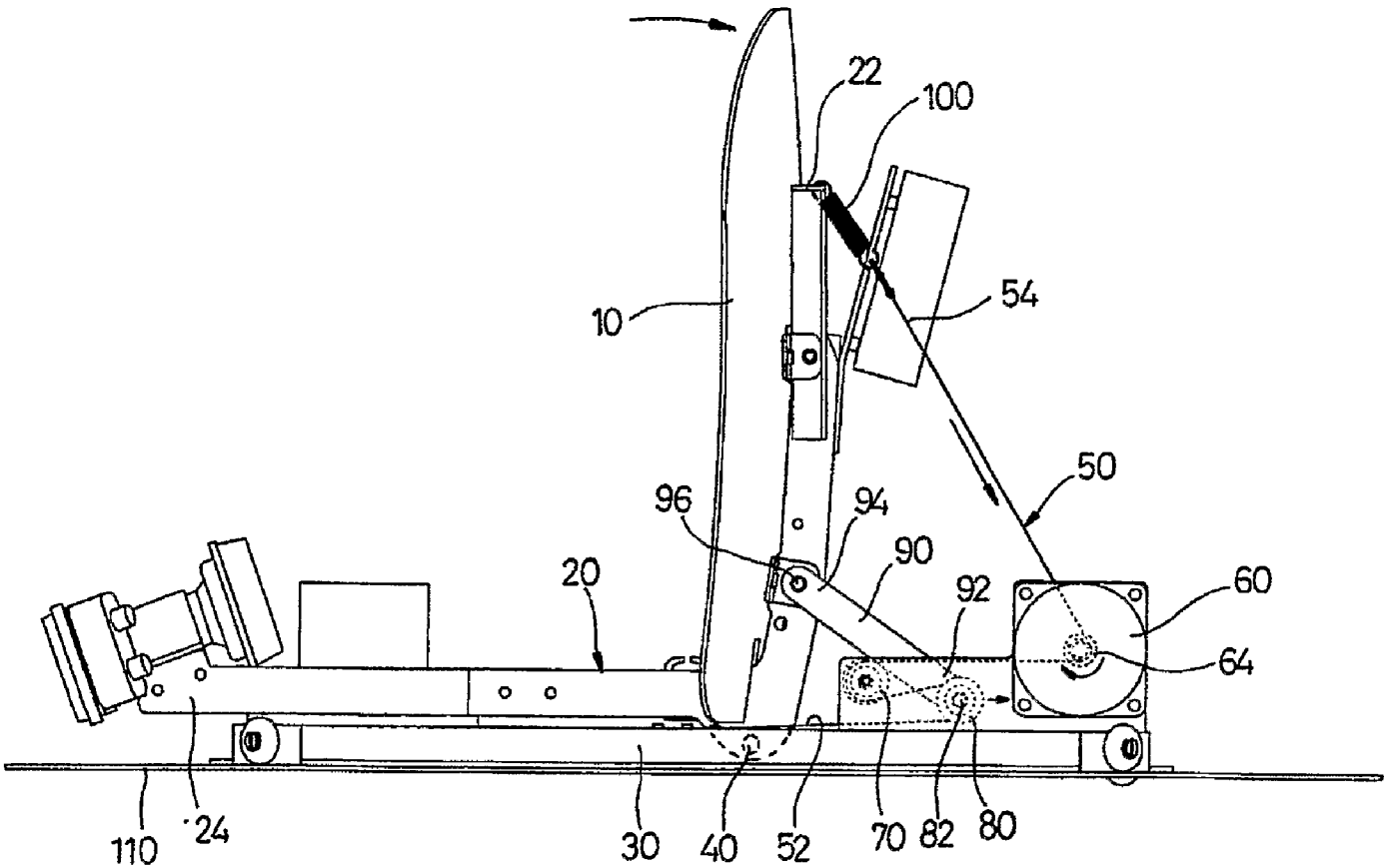
FIG. 5 is a side view of the satellite antenna employing the lowest elevation angle control apparatus according to a preferred embodiment of the present invention.
Figure 6:
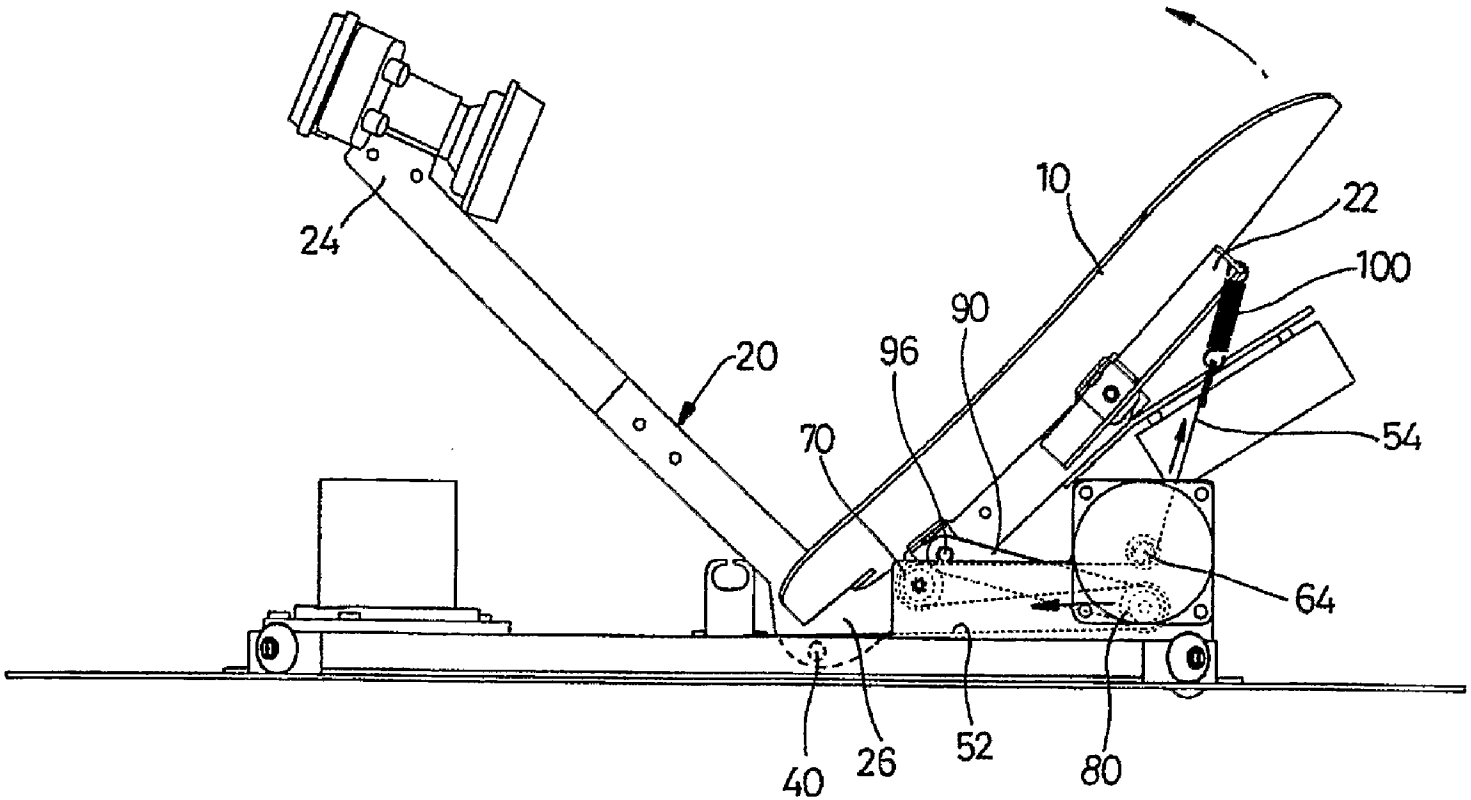
FIG. 6 is a side view of the satellite antenna employing the highest elevation angle control apparatus according to a preferred embodiment of the present invention.

FIGS. 5 and 6 show the operation of the elevation angle control apparatus according to a preferred embodiment of the present invention. FIG. 5 shows the lowest elevation angle of the satellite antenna 10 and FIG. 6 shows the highest elevation angle of the satellite antenna 10.

First, the case that the elevation angle of the satellite antenna 10 is adjusted from a small elevation angle to a large elevation angle is described. In the state shown in FIG. 5, when the driving motor 60 rotates in a predetermined direction (clockwise in the drawing), the other end 54, the upper end of the belt 50 is pulled and the one end 52, the lower end of the belt 50 is released. Due to these movements, the upper end 22 of the frame 20 is being laid down and the elevation angle of the satellite antenna 10 is increased.

Meanwhile, in the above-mentioned state, since the length of the one end 52, the lower end of the belt 50 is increased, the movable pulley 80 is retreated toward the driving pulley 64 such that the rod 90 supports the frame 20 and the frame 20 is stably laid down without backlash, and as a result, the elevation angle is increased as shown in FIG. 6. Moreover, since force applied to the elevation angle shaft 40 due to the supporting operation of the rod 90 is distributed to the rod 90, damage of the elevation angle shaft 40 is minimized, and as a result, durability of the satellite antenna 10 is increased.

Next, in order to decrease the elevation angle, in the state depicted in FIG. 6, when the driving motor 60 rotates in the direction (counterclockwise) opposite to the direction depicted in FIG. 5, the one end 52, the lower end of the belt 50 is pulled and the other end 54, the upper end of the belt 50 is released. At this time, since the one end 52, the lower end of the belt 50 is relatively shortened, the movable pulley 80 moves toward the fixed pulley 70, and due to this movements, the rod 90 pushes and erects the frame 20. In the state of erecting the frame 20, the belt 50 connected to the upper end of the frame 20 is released from the state of holding the frame 20 with a proper tensile force, the frame 20 is stably erected without backlash, and as a result, the elevation angle of the frame 20 is decreased as shown in FIG. 5.

Meanwhile, the erection of the frame 20 is performed by pushing action of the rod 90 due to the forward movement of the movable pulley 80 receiving the driving force of the driving motor 60 via the belt 50. Since the belt 50 passes through the fixed pulley 70 and travels to rotate the movable pulley 80, this structure forms a mechanical mechanism for erecting the frame 20 with weak force using the pulley principle. Thus, since the driving motor 60 does not receive a large load when adjusting the elevation angle, a driving motor with a small driving torque can be used, and as a result, the elevation angle control apparatus can be manufactured in small size and manufacturing costs can also be reduced.

Figure 7:
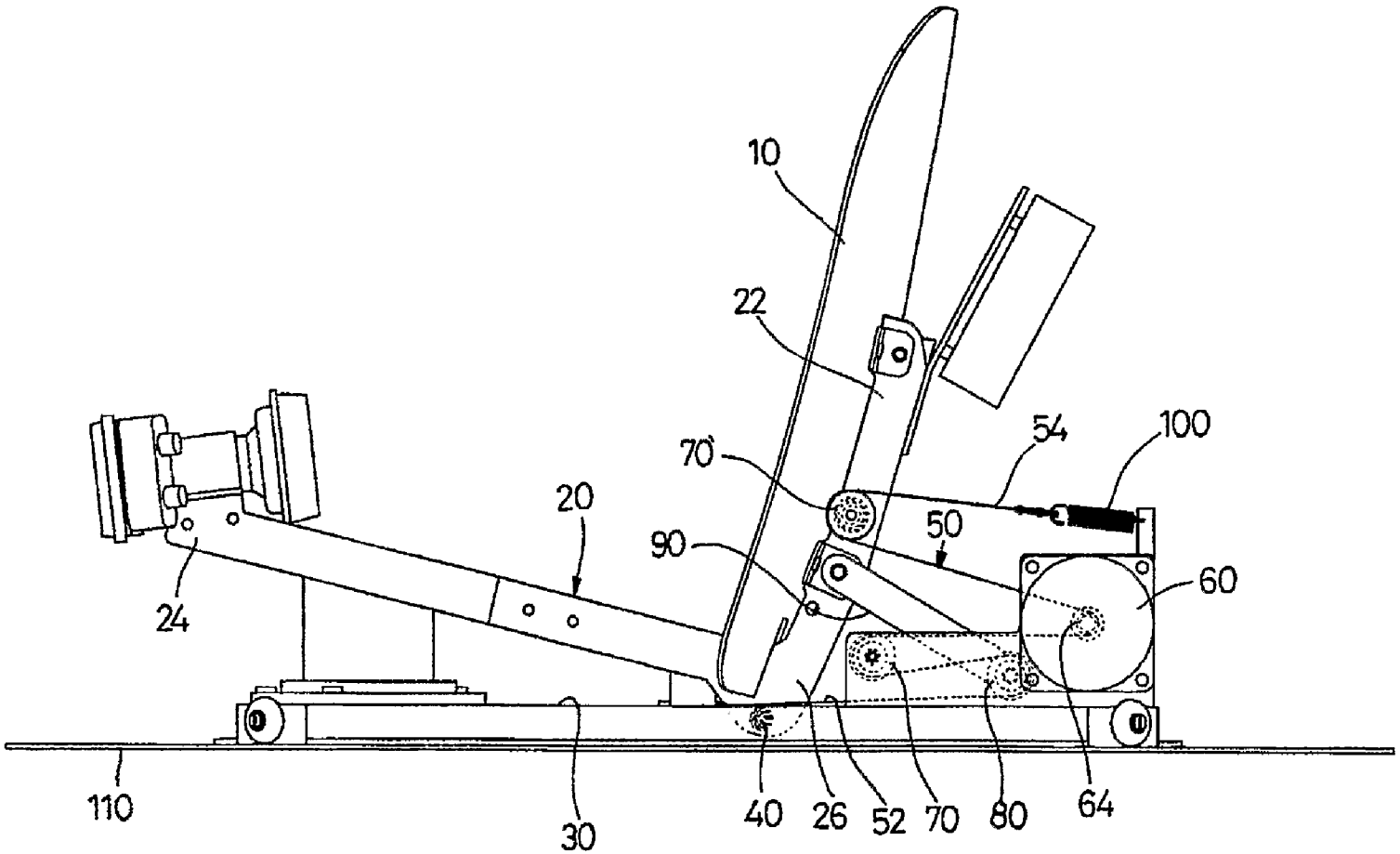
FIG. 7 is a side view of a satellite antenna employing an elevation angle control apparatus according to another preferred embodiment of the present invention.

FIG. 7 shows an elevation angle control apparatus according to another preferred embodiment of the present invention. In the elevation angle control apparatus according to another preferred embodiment of the present invention, different from the above-mentioned preferred embodiment of the present invention shown in FIGS. 1 to 6, the other end 54 of the belt 50 is also fixed to the supporting bracket 30, the belt 50 is fixed to the supporting bracket 30 via another fixed pulley 70' installed to the frame 20. This preferred embodiment is identical to the preferred embodiment shown in FIGS. 1 to 6, except that both ends 52 and 54 of the belt 50 is fixed to the supporting bracket 30 and the fixed pulley 70' is added between the intermediate part 26 and the upper end 22 of the frame 20 to which the elevation angle shaft 40 is installed.

The elevation angle control apparatus shown in FIG. 7 employs the pulley principle to the one end 52 and the other end 54 of the belt 50, whereby has advantage that a small load is applied to the driving motor 60 when increasing and decreasing the elevation angle.

The operation of the elevation angle control apparatus according to this preferred embodiment of the present invention is substantially identical to that of the elevation angle control apparatus according to the above-mentioned preferred embodiment, and since its description will be obvious to those skilled in the art, a description thereof will be omitted.

INDUSTRIAL APPLICABILITY

As described above, since the elevation angle control apparatus uses the belt, in which both ends thereof are fixed to the supporting bracket and the frame respectively, a pair of fixed pulleys, a pair of movable pulleys, and the rod having the one end, to which the one end of the movable pulley is connected and the other end pivotally connected to the frame, which are disposed at the rear side of the frame, interference generated when receiving satellite signals is minimized and volume of the satellite antenna employing the elevation angle control apparatus is reduced. The backlash generated when adjusting the elevation angle is effectively reduced by the pulling actions of belt and the supporting action of the rod contrary to the pulling action of the belt, and minute adjustments to the elevation angle are stably performed. Moreover, regardless of the frame's shape or form, the elevation angle control apparatus according to the present invention can be applied to parabolic satellite antennas and flat type satellite antennas.

Although the preferred embodiments of the present invention have been disclosed for illustrative purposes, it is understood that technical scope of the present invention is not limited to the above description and those skilled in the art will appreciate that various modifications, additions and substitutions are possible, without departing from the scope and spirit of the invention as disclosed in the accompanying claims.

The invention claimed is:

1. An elevation angle control apparatus for adjusting an elevation angle of a satellite antenna 10 by adjusting an angle of a frame 20, pivotally fixed to a supporting bracket 30 by an elevation angle shaft 40, to which the satellite antenna 10 is fixed, the elevation angle control apparatus comprising:

a belt 50 in which one end 52 is fixed to the supporting bracket 30 and the other end thereof 54 is fixed to an upper end 22 of the frame 20;

a driving motor 60 mounted on the supporting bracket 30 and driving the belt 50;

a fixed pulley 70 rotatably fixed to the supporting bracket 30 between the driving motor 60 and the one end 52 of the belt 50 fixed to the supporting bracket 30;

a movable pulley 80 disposed between the fixed pulley 70 and the one end 52 of the belt 50 fixed to the supporting bracket 30; and a rod 90 in which the movable pulley 80 is rotatably fixed to one end 92 of the rod and the other end 94 thereof is pivotally fixed between the elevation angle shaft 40 and the upper end 22 of the frame 20;

wherein the belt 50 is connected from the upper end 22 of the frame 20 to the supporting bracket 30 via the driving motor 60, the fixed pulley 70 and the movable pulley 80, and the angle of the frame 20 is adjusted such that the frame 20 is rotated about the elevation angle shaft 40 by pulling of the belt 50 caused by forward and backward rotation of the driving motor 60 and by movement of the rod 90 caused by the pulling of the belt 50.

2. The elevation angle control apparatus for adjusting the elevation angle of the satellite antenna 10 as set forth in claim 1, further comprising an elastic member 100 disposed between the other end 54 of the belt 50 and the frame 20.

3. The elevation angle control apparatus for adjusting the elevation angle of the satellite antenna 10 as set forth in claim 2, wherein the elastic member 100 comprises a tensile coil spring.

4. The elevation angle control apparatus for adjusting the elevation angle of the satellite antenna 10 as set forth in claim 1, wherein the movable pulley 80 closely contacts an upper surface of the supporting bracket 30 and slides the upper surface of the supporting bracket 30 in a state that the belt 50 is wound around the movable pulley 80.

5. An elevation angle control apparatus for adjusting an elevation angle of a satellite antenna 10 by adjusting an angle of a frame 20, pivotally fixed to a supporting bracket 30 by an elevation angle shaft 40, to which the satellite antenna 10 is fixed, the elevation angle control apparatus comprising:

a belt 50 in which one end 52 and the other end 54 thereof are fixed to the supporting bracket 30;

a driving motor 60 mounted on the supporting bracket 30 and driving the belt 50;

a fixed pulley 70 rotatably fixed to the supporting bracket 30 between the driving motor 60 and the one end 52 of the belt 50 fixed to the supporting bracket 30;

an additional fixed pulley 70' installed between an upper end 22 of the frame 20 and the elevation angle shaft 40;

a movable pulley 80 disposed between the fixed pulley 70 and the one end 52 of the belt 50 fixed to the supporting bracket 30; and a rod 90 in which the movable pulley 80 is rotatably fixed between one end 92 thereof and the other end 94 thereof is pivotally fixed to the elevation angle shaft 40 of the frame 20 and the additional fixed pulley 70';

wherein the belt 50 is connected from the supporting bracket 30 to the supporting bracket 30 via the additional fixed pulley 70' installed to the frame 20, the driving motor 60, the fixed pulley 70, and the movable pulley 80, and the angle of the frame 20 is adjusted such that the frame 20 is rotated about the elevation angle shaft 40 by pulling of the belt 50 caused by forward and backward rotation of the driving motor 60 and by movement of the rod 90 caused by the pulling of the belt 50.

6. The elevation angle control apparatus for adjusting elevation angle of a satellite antenna 10 as set forth in claim 5, further comprising an elastic member 100 disposed between the other end 54 of the belt 50 and the frame 20.

7. The conductive elevation angle control apparatus for adjusting elevation angle of a satellite antenna 10 as set forth in claim 6, wherein the elastic member 100 comprises a tensile coil spring.

* * * * *